US012807385B2

(12) United States Patent
Ryan

(10) Patent No.: US 12,807,385 B2
(45) Date of Patent: Nov. 24, 2026

(54) PACKAGE SYSTEM FOR TABLETS

(71) Applicant: Stellar Manufacturing, LLC, Sauget, IL (US)

(72) Inventor: Kevin Ryan, Millstadt, IL (US)

(73) Assignee: Stellar Manufacturing, LLC, Sauget, IL (US)

( * ) Notice: Subject to any disclaimer, the term of this patent is extended or adjusted under 35 U.S.C. 154(b) by 198 days.

(21) Appl. No.: 18/136,799

(22) Filed: Apr. 19, 2023

(65) Prior Publication Data

US 2023/0339664 A1 Oct. 26, 2023

Related U.S. Application Data

(60) Provisional application No. 63/332,732, filed on Apr. 20, 2022.

(51) Int. Cl.

| | |
|---|---|
| ***B65D 71/06*** | (2006.01) |
| ***B65B 9/08*** | (2012.01) |
| ***B65B 61/02*** | (2006.01) |
| ***B65B 61/14*** | (2006.01) |

(52) U.S. Cl.

CPC ..... *B65D 71/063* (2013.01); *B65B 9/08* (2013.01); *B65B 61/02* (2013.01); *B65B 61/14* (2013.01); *B65D 2571/00135* (2013.01); *B65D 2571/0045* (2013.01)

(58) Field of Classification Search

CPC .. B65D 2571/00135; B65D 2571/0045; B65D 71/063; B65B 9/08; B65B 61/02; B65B 61/14

USPC ..... 206/528, 535, 540; 383/7, 10, 61.2, 207, 383/200, 203, 204

See application file for complete search history.

(56) References Cited

U.S. PATENT DOCUMENTS

| | | | | |
|---|---|---|---|---|
| D138,698 | S * | 9/1944 | Salfisberg | D9/701 |
| 2,976,988 | A * | 3/1961 | Schneider | B65D 75/5822 206/445 |
| 4,205,750 | A * | 6/1980 | Dews | B65D 77/06 53/442 |
| 4,429,792 | A * | 2/1984 | Machbitz | B65D 75/327 206/532 |
| 4,474,294 | A * | 10/1984 | Koppelmans | B65D 75/367 312/61 |
| 4,911,291 | A * | 3/1990 | Iwata | B65D 83/04 206/532 |
| 6,207,048 | B1 * | 3/2001 | Bonelli | C02F 1/685 210/252 |
| 7,988,359 | B1 * | 8/2011 | Sussman | B65D 33/08 383/14 |
| 8,061,897 | B2 * | 11/2011 | Ichikawa | B65D 75/5855 383/35 |
| 8,256,958 | B2 * | 9/2012 | Rush | B32B 3/266 383/116 |
| 8,944,684 | B2 * | 2/2015 | Bell | B65D 33/02 383/203 |
| 2002/0088737 | A1 * | 7/2002 | Stepp | A61J 1/035 206/538 |
| 2003/0077006 | A1 * | 4/2003 | Siegel | B65D 75/5805 383/10 |

(Continued)

*Primary Examiner* — Jacob K Ackun

(74) *Attorney, Agent, or Firm* — Snell & Wilmer L.L.P.

(57) ABSTRACT

A package system includes a plurality of water treatment tablets stacked in a multi-level array and a layer of film. The multi-level layer of film can have a generally planar lower surface, a generally planar upper surface, and a sealed edge.

20 Claims, 6 Drawing Sheets

(56) References Cited

U.S. PATENT DOCUMENTS

| | | | | |
|---|---|---|---|---|
| 2003/0156981 | A1* | 8/2003 | Mills | A01N 59/00 424/408 |
| 2003/0169947 | A1* | 9/2003 | Taheri | B65D 33/004 383/204 |
| 2005/0173353 | A1* | 8/2005 | Connelly | C02F 1/76 210/753 |
| 2006/0210199 | A1* | 9/2006 | Ali | B65D 75/5866 383/906 |
| 2007/0104395 | A1* | 5/2007 | Kinigakis | B65D 75/5855 383/203 |
| 2007/0235369 | A1* | 10/2007 | Perell | B65D 75/5855 206/538 |
| 2010/0054634 | A1* | 3/2010 | Runyon | B65D 33/08 383/10 |
| 2010/0142859 | A1* | 6/2010 | Cushman | A47J 43/27 493/267 |
| 2010/0200454 | A1* | 8/2010 | Goglio | B32B 7/12 206/528 |
| 2013/0233877 | A1* | 9/2013 | Thimmesch | B65D 75/566 383/7 |
| 2014/0339176 | A1* | 11/2014 | Mastio | C02F 1/688 210/749 |
| 2015/0238372 | A1* | 8/2015 | Bhattacharjee | B65D 33/08 383/10 |
| 2015/0251815 | A1* | 9/2015 | Berger | B31B 70/876 156/69 |
| 2016/0023809 | A1* | 1/2016 | Leeker | B65B 9/2056 493/227 |

* cited by examiner

PACKAGE SYSTEM FOR TABLETS

CROSS REFERENCE TO RELATED APPLICATIONS

This application is a non-provisional of, and claims priority to and the benefit of U.S. Provisional Application No. 63/332,732, entitled "PACKAGE SYSTEM FOR TABLETS," filed on Apr. 20, 2022. The disclosure of the foregoing application is incorporated herein by reference in its entirety, including but not limited to those portions that specifically appear hereinafter, but except for any subject matter disclaimers or disavowals, and except to the extent that the incorporated material is inconsistent with the express disclosure herein, in which case the language in this disclosure shall control.

TECHNICAL FIELD

The subject matter herein relates generally to a package system for tablets, and more specifically for flexible packaging for stacked or collated water treatment tablets.

BACKGROUND OF THE INVENTION

Typically, packaging of water treatment types, such as those used in the residential pool industry, are packaged in a High-Density Polyethylene (HDPE) pail and lid. This type of packaging has a number of disadvantages including high cost and high waste. For example, HDPE pails generally have a low recycling rate with many HDPE pails ending up disposed of in landfills. In addition, HDPE pails poorly utilize space for the purposes of storage and shipping. Further, current cost and/or waste saving packaging materials have difficulties holding caustic and dangerous pool chemicals without failing.

Accordingly, there is a need for a package system for water treatment tablets that is low cost, low waste, and more space-efficient while at the same time being capable of holding caustic chemicals.

SUMMARY

In one embodiment, a package system is provided that includes a plurality of tablets stacked in a multi-level array, the multi-level array having a generally planar lower surface and a generally planar upper surface; and a layer of film configured to enclose the plurality of tablets, the layer of film having a generally planar upper surface, a generally planar lower surface, a perimeter, and a sealed edge around at least a portion of the perimeter.

Figure 1:
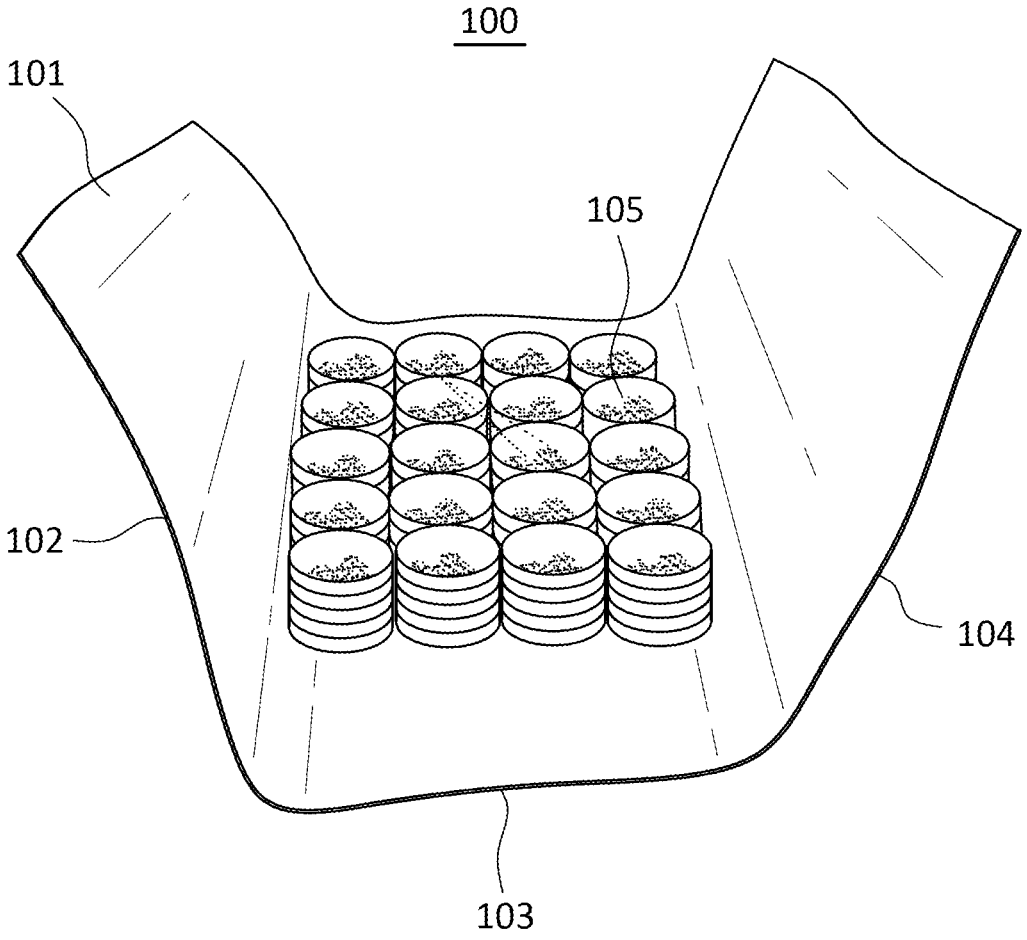
FIG. 1 is a perspective view of a layer of film and a plurality of tablets stacked in a multi-layer array in accordance with an embodiment.

For simplicity and clarity of illustration, the drawing figures illustrate the general manner of construction, and descriptions and details of some features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DETAILED DESCRIPTION OF THE INVENTION

Turning now to FIG. 1, a perspective view of an exemplary packaging system 100 is shown prior to sealing. In many embodiments, packaging system 100 can comprise a layer of film 101 comprising one or more open edges 102-104 and/or a plurality of tablets 105. Prior to being sealed, plurality of tablets 105 can be placed onto the layer of film 101. Plurality of tablets 105 can be arranged in a polygonal array when placed on layer of film 101. An arrangement of tablets in a polygonal array can be described in a number of ways. For example, system 100 displays a four tablet by five tablet rectangular array. In some arrays, which can be referred to as multi-layer arrays, multiple layers of tablets 105 can be stacked prior to being sealed. For example, system 100 displays a five layer array where one tablet is stacked on top of another. Tablets 105 are shown with an approximately cylindrical shape, but it will be understood that other shapes can also be used. For example, a tablet can be shaped as a box, cube, pyramid, sphere, and may other shapes. Generally speaking, tablets 105 can be comprised of chemical composition used for water treatment in pools. For example, a tablet can be comprised of Chlorine, Bromine, muriatic (or some other) acid, sodium bicarbonate (or some other base), a flocculant, an algaecide, a bactericide, a bacteriostatic compound, or many other pool chemicals. Generally speaking, layer of film 101 can comprise a flexible polymer material (e.g., a plastic) for various formulations. In some embodiments, layer of film 101 can be formulated to resist degradation when in contact with a corrosive substance. For example, polyvinyl chloride can be used in layer of film 101 due to its resistance to chemical degradation.

Figure 2:
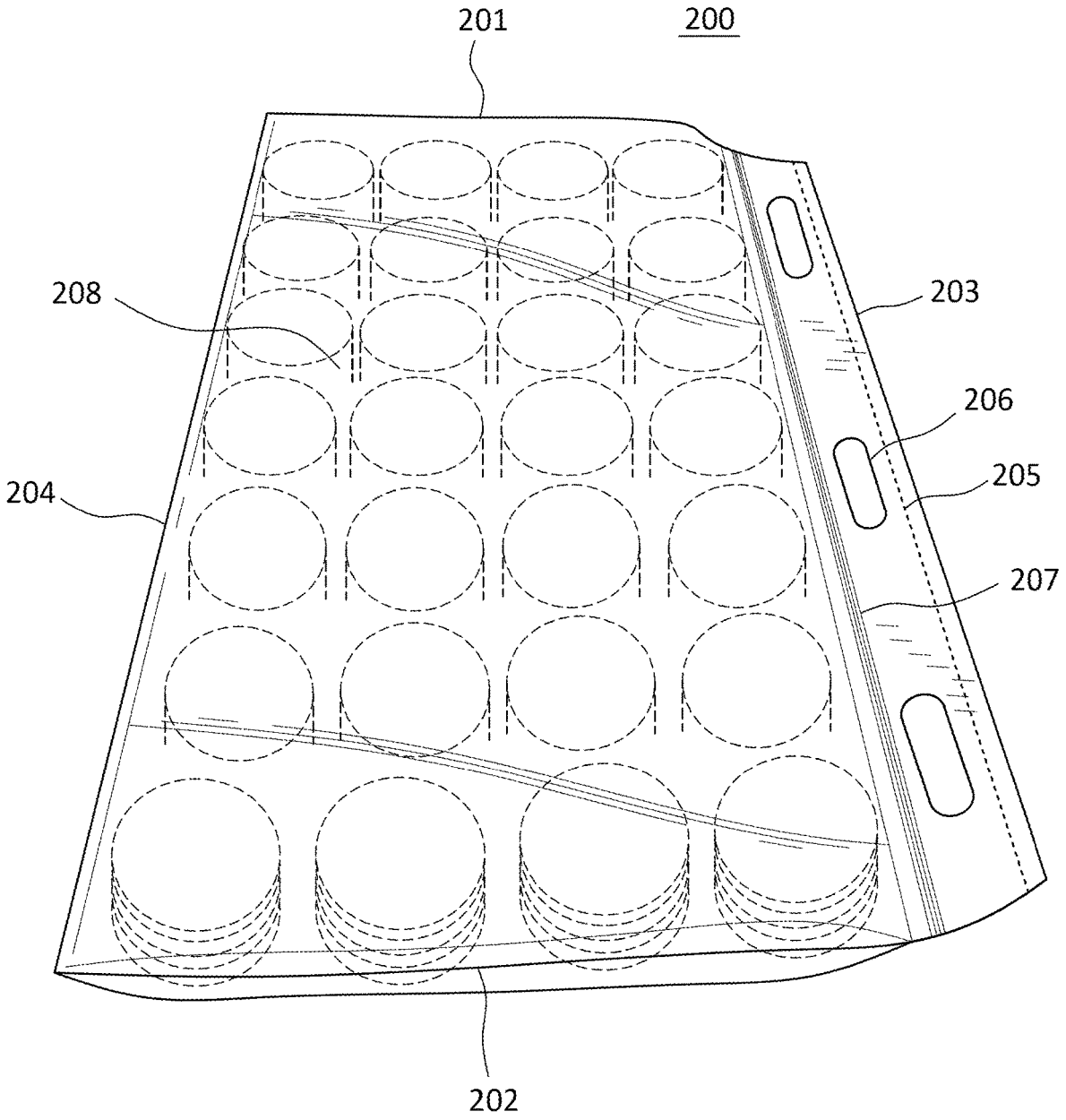
FIG. 2 is a perspective view of a package system in accordance with an embodiment.

Turning now to FIG. 2, a perspective view of a sealed package system 200 is shown. While a dashed outline of a number of tablets can be seen in FIG. 2 (as well as in FIGS. 5 and 8-10), it should be understood that this is merely for illustration. System 200 can be fully opaque, fully translucent, and/or any type of intermediate between the two. In embodiments where a system 200 is opaque, light sensitive chemicals in a tablet (e.g., one or more of tablets 105 (FIG. 1)) can be protected from degradation. System 200 can also be partially opaque and/or translucent on different parts of the system. For example, system 200 can have opaque branding, ingredients listings, and/or legal warnings/disclaimers while having a window of translucence to show tablets inside the system.

Figure 3:
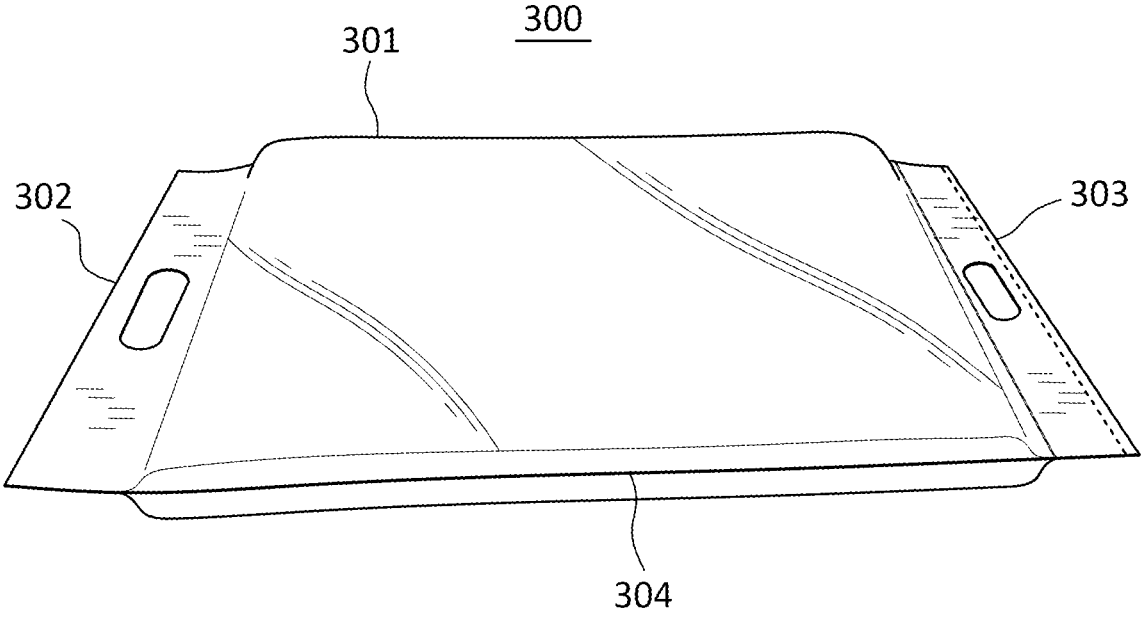
FIG. 3 is a first alternate embodiment of a package system in accordance with an embodiment.

In many embodiments, package system 200 can comprise sealed edges 201-203, a folded edge 204, an uncoupling guide 205, a handle 206, a closing mechanism 207, a generally planar upper surface 208, and/or a generally planar lower surface (not shown). Generally speaking, packaging system 200 can be created by folding layer of film 101 (FIG. 1) over itself to create folded edge 204 and then sealing one or more of open edges 102-104 (FIG. 1) to create sealed edges 201-203, thereby enclosing plurality of tablets 105 (FIG. 1) within package system 200. In some embodiments, folded edge 204 can be omitted and all edges of package system 200 can be sealed. For example, FIG. 3 shows a package system 300 having four sealed edges 301-304. Returning now to FIG. 2, it should be understood that while only one folded edge 204 is shown in package system 200, multiple folded edges can be created by folding additional portions of layer of film 101 (FIG. 1) over and/or along itself. Generally speaking, sealed edges 201-203 and/or folded edge 204 can be located near a perimeter of package system 200. Sealed edges 201-203 can each be created in a number of ways. For example, sealed edges 201-203 can be created using a heat sealer, an adhesive, one or more fasteners, and/or or some other method of coupling one or more open edges 102-104 (FIG. 1).

Generally speaking, uncoupling guide 205 can comprise a mechanism configured to allow a user to uncouple folded edge 204, thereby creating a new open edge. Uncoupling guide 205 can be located closer to a center of package system 200 than one or more of sealed edges 201-203 and/or folded edge 204. Uncoupling guide 205 can take a number of forms. For example, uncoupling guide can comprise a perforation, a pull tab, an indentation, a bevel, and/or cutting guide (e.g., a line created by a sealing mechanism and/or a "cut here" or some similar indication). Handle 206 can generally be configured to support a weight of a plurality of tablets 105 (FIG. 1). Therefore, a construction of handle 206 can be varied depending on a number of tablets in system 200. For example, a grippable portion of handle 204 can be reinforced and/or made thicker when more tablets are included in system 200. Handle 206 can be located closer to a center of system 200 than uncoupling guide 205, thereby allowing handle 206 to remain functional after uncoupling guide 205 is used to uncouple layer of film 101 (FIG. 1). Closing mechanism 207 can comprise a variety of resealable closures. For example, closing mechanism 207 can comprise a press and seal closure (similar to ones used by the ZIPLOC® brand), a reusable adhesive, and/or an external clip.

While uncoupling guide 205 and handle 206 are shown to be proximate to a sealed edge, it should be understood that, in other embodiments, they can be placed proximate to folded edge 204. As another example, additional uncoupling guides and/or handles can be included in package system 200 proximate to other sealed edges and/or folded edge 204.

Figure 4:
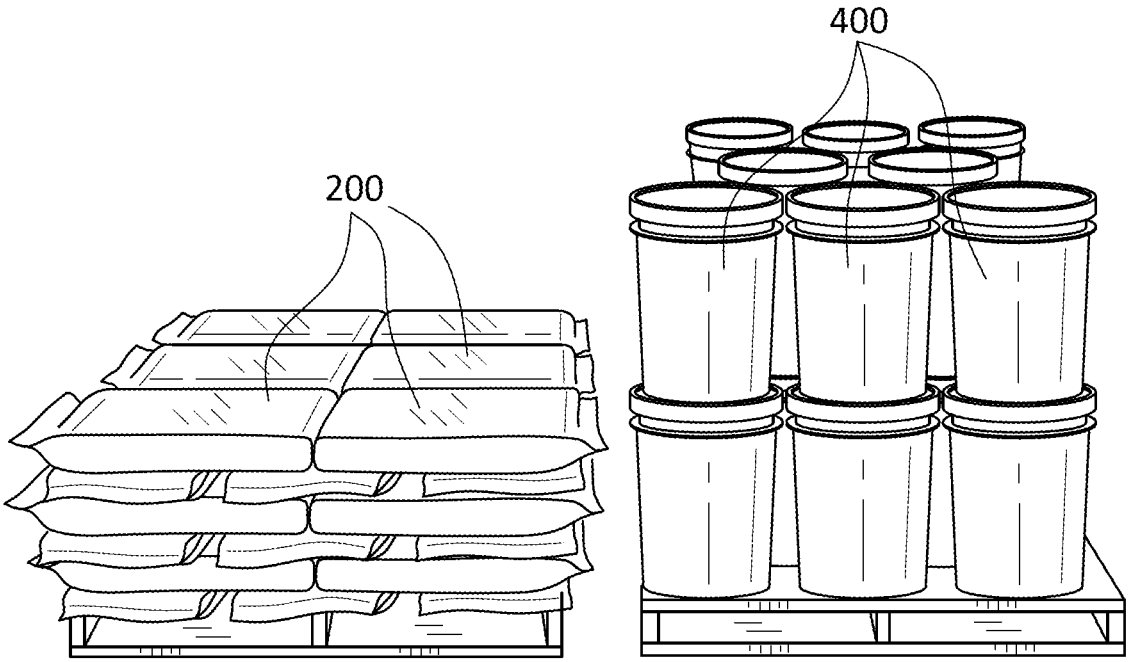
FIG. 4 is a perspective view of a plurality of package systems stacked in a multi-layered array.

Turning now to FIG. 4, a perspective view of a plurality of package systems 200 stacked next to a plurality of industry standard enclosures 400 for storage of water treatment tablets is shown. Each stack of plurality of package systems 200 and plurality of industry standard enclosures 400 contain approximately similar weights of water treatment tablets. As can be seen from FIG. 4, package system 200 can enclose a similar weight of water treatment tablets in approximately half as much volume as industry standard enclosures 400. This, in turn, can lead to lower shipping costs to a destination and lower holding costs as product is stored in a storage area (e.g., a storeroom and/or on a shelf in a pool supply store). Further, system 200 also uses less material in its construction than industry standard enclosures 400 because merely a layer of film is needed instead of the thicker walls of industry standard enclosures 400.

Figure 5:
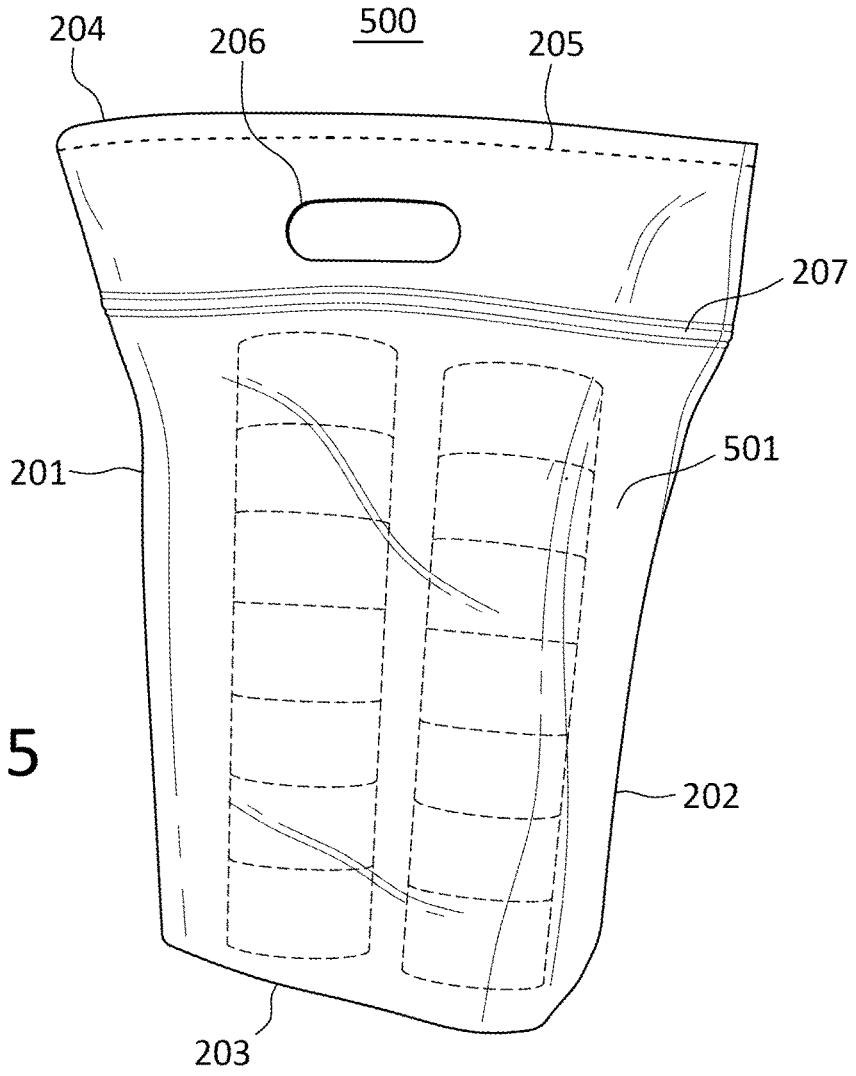
FIG. 5 is a perspective view of a package system in accordance with an embodiment.

Turning now to FIG. 5, an exemplary packaging system 500 is shown. Generally speaking, package system 500 can comprise a multi-layer array of tablets. For example, package system 500 comprises a one by two array with seven layers of tablets. Similar to package system 200 (FIG. 2), package system 500 can comprise sealed edges 201-203, a folded edge 204, an uncoupling guide 205, handle 206, and/or a closing mechanism 207. While package system 200 (FIG. 2) comprises a generally planar upper surface 208 (FIG. 2) and a generally planar lower surface 209 (FIG. 2), due to the addition of further layers and subtraction of rows and columns in the polygonigal array, package system 500 comprises a generally planar front surface 501 and a generally planar back surface (not shown).

Figure 6:
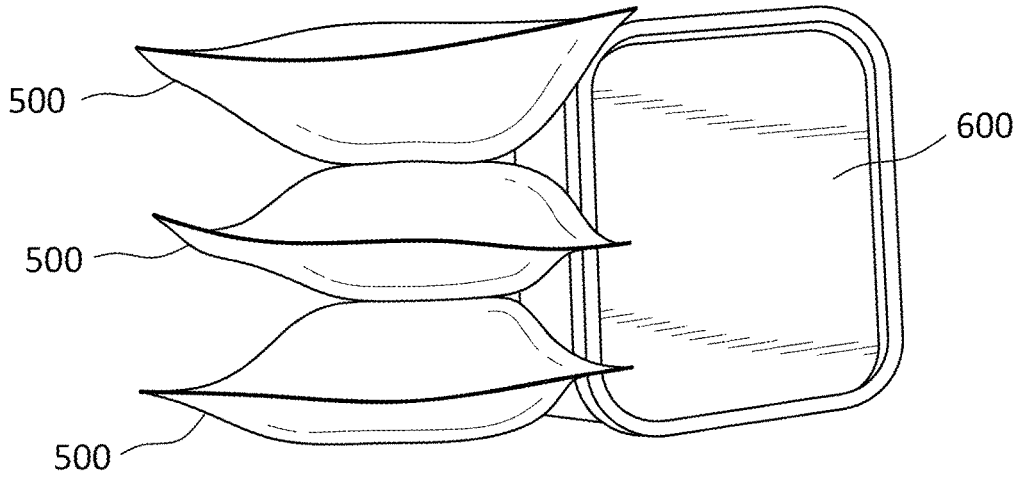
FIG. 6 is a top view of a plurality of package systems in accordance with an embodiment.

Turning now to FIG. 6, a perspective view of a plurality of package systems 500 arranged next to an industry standard enclosure 600 for storage of water treatment tablets is shown. Each package system 500 and industry standard enclosure 600 contain approximately similar weights of water treatment tablets. As can be seen from FIG. 6, package system 500 can enclose a three times the weight of water treatment tablets in approximately the same amount of volume as industry standard enclosure 600. This, in turn, can lead to lower shipping costs to a destination and lower holding costs as product is stored in a storage area (e.g., a storeroom and/or on a shelf in a pool supply store). Further, system 500 also uses less material in its construction than industry standard enclosure 600 because merely a layer of film is needed instead of the thicker walls of industry standard enclosures 600.

Figure 7:
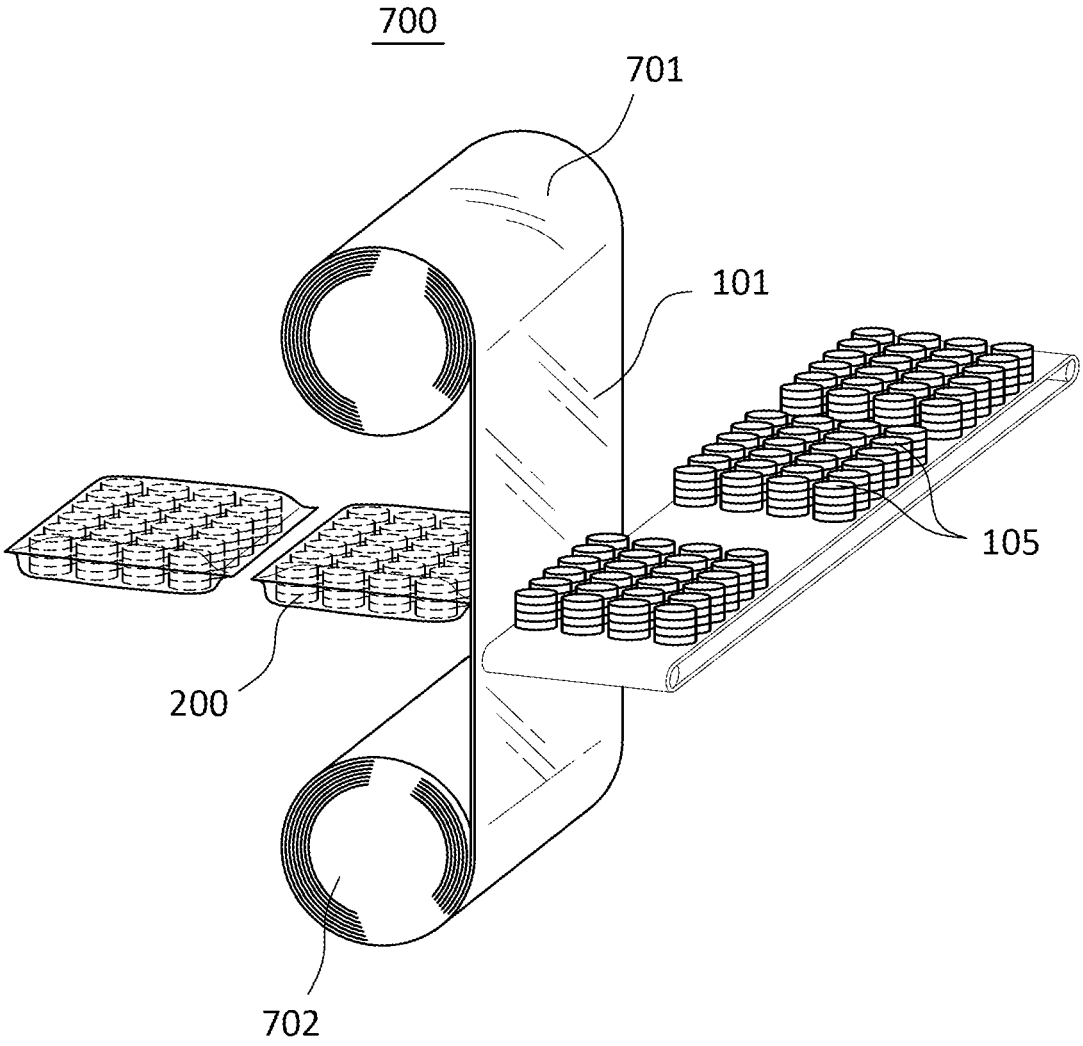
FIG. 7 is a diagram of a manufacturing system for a package system for tablets in accordance with an embodiment.

Turning now to FIG. 7, a manufacturing system 700 for creating package system 200 (FIG. 2) is shown. In operation, a plurality tablets 105 move through a curtain 701 comprising layer of film 101, thereby enclosing the plurality of tablets 105. Generally speaking, layer of film 101 can be dispensed from one or more rollers 702 as plurality of tablets 105 move through curtain 701. Layer of film 101 can then be sealed to enclose the plurality tablets 105 to form a package system. Additional elements of a package system (e.g., an uncoupling guide, a handle, and/or a closing mechanism) can be coupled to, punched out of, and/or impressed into layer of film 101 when used in system 700. These additional elements can also be added after layer of film 101 is sealed.

Figure 8:
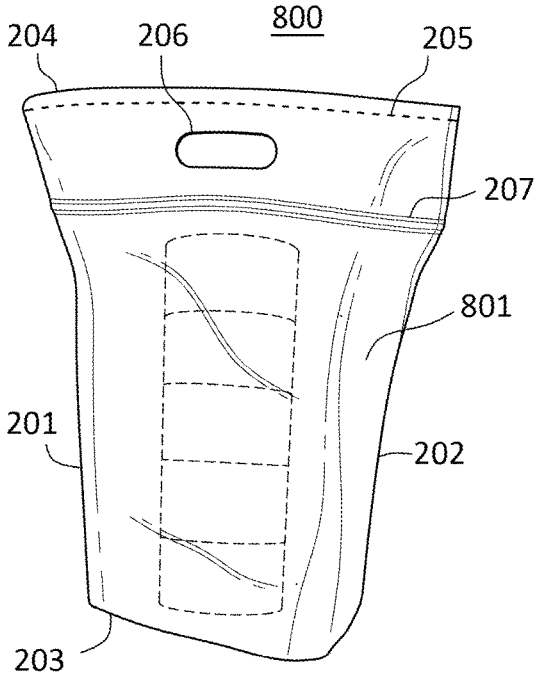
FIG. 8 is a perspective view of a package system in accordance with an embodiment.

Turning now to FIG. 8, an exemplary packaging system 800 is shown. Generally speaking, package system 800 can comprise a multi-layer array of tablets. For example, package system 800 comprises a one by one array with five layers of tablets. Similar to package system 200 (FIG. 2), package system 800 can comprise sealed edges 201-203, a folded edge 204, an uncoupling guide 205, handle 206, and/or a closing mechanism 207. While package system 200 (FIG. 2) comprises a generally planar upper surface 208 (FIG. 2) and a generally planar lower surface 209 (FIG. 2), due to the addition of further layers and subtraction of rows and columns in the polygonigal array, package system 800 comprises a generally planar front surface 801 and a generally planar back surface (not shown).

Figure 9:
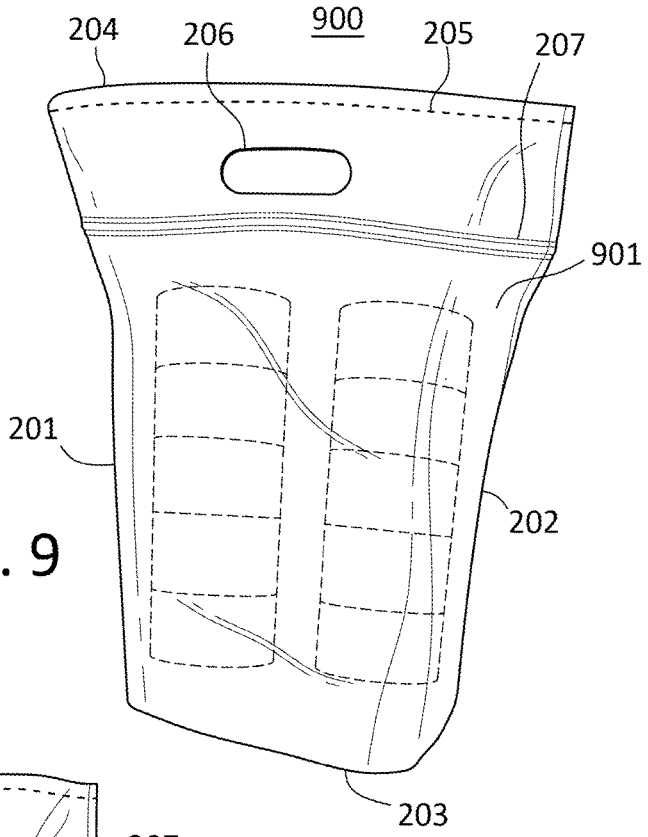
FIG. 9 is a perspective view of a package system in accordance with an embodiment.

Turning now to FIG. 9, an exemplary packaging system 900 is shown. Generally speaking, package system 900 can comprise a multi-layer array of tablets. For example, package system 900 comprises a two by one array with five layers of tablets. Similar to package system 200 (FIG. 2), package system 900 can comprise sealed edges 201-203, a folded edge 204, an uncoupling guide 205, handle 206, and/or a closing mechanism 207. While package system 200 (FIG. 2) comprises a generally planar upper surface 208 (FIG. 2) and a generally planar lower surface 209 (FIG. 2), due to the addition of further layers and subtraction of rows and columns in the polygonigal array, package system 900 comprises a generally planar front surface 901 and a generally planar back surface (not shown).

Figure 10:
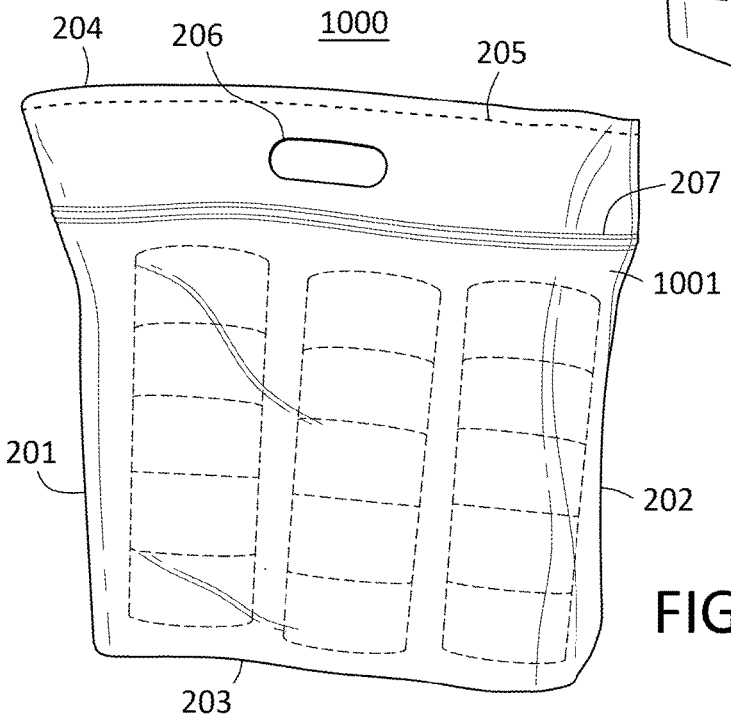
FIG. 10 is a perspective view of a package system in accordance with an embodiment.

Turning now to FIG. 10, an exemplary packaging system 1000 is shown. Generally speaking, package system 1000 can comprise a multi-layer array of tablets. For example, package system 1000 comprises a three by one array with five layers of tablets. Similar to package system 200 (FIG. 2), package system 1000 can comprise sealed edges 201-203, a folded edge 204, an uncoupling guide 205, handle 206, and/or a closing mechanism 207. While package system 200 (FIG. 2) comprises a generally planar upper surface 208 (FIG. 2) and a generally planar lower surface 209 (FIG. 2), due to the addition of further layers and subtraction of rows and columns in the polygonigal array, package system 1000 comprises a generally planar front surface 1001 and a generally planar back surface (not shown).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A package system, comprising:

a plurality of water treatment tablets comprising a caustic, light sensitive chemical, the plurality of water treatment tablets arranged in a multi-layer array comprising the plurality of water treatment tablets stacked in a plurality of columns arranged in a polygonal shape, each of the plurality of columns comprising multiple water treatment tablets stacked one on another before a single, opaque layer of film is sealed;

the single, opaque layer of film comprising polyvinyl chloride, the single, opaque layer of film enclosing the plurality of water treatment tablets, the single, opaque layer of film being formulated to resist degradation when in contact with a corrosive substance, the single, opaque layer of film having a generally planar upper surface, a generally planar lower surface, three or more sealed edges created by sealing one or more open edges of the single, opaque layer of film, and at least one folded edge created by folding the single, opaque layer of film over itself;

an approximate center of the package system;

an uncoupling guide in between at least one of the three or more sealed edges or the at least one folded edge and the approximate center;

a handle in between the uncoupling guide and the approximate center; and a closing mechanism in between the handle and the approximate center.

2. The package system of claim 1, wherein the three or more sealed edges are located proximate to a perimeter of the single, opaque layer of film.

3. The package system of claim 1, wherein the handle is proximate to the three or more sealed edges and wherein the handle is formed by reinforcing a portion of the single, opaque layer of film to support a weight of the plurality of water treatment tablets.

4. The package system of claim 1, wherein the closing mechanism is proximate to the three or more sealed edges, wherein the closing mechanism comprises a resealable adhesive configured to allow multiple openings and resealings.

5. The package system of claim 4, wherein the closing mechanism comprises a press and seal mechanism.

6. The package system of claim 1, wherein the plurality of water treatment tablets comprise chlorine tablets.

7. The package system of claim 1, wherein the single, opaque layer of film is configured to protect the light sensitive chemical from degradation.

8. A method of forming a package system comprising:

providing a plurality of water treatment tablets comprising a caustic, light sensitive chemical, the plurality of water treatment tablets arranged in a multi-layer array comprising the plurality of water treatment tablets stacked in a plurality of columns arranged in a polygonal shape, each of the plurality of columns comprising multiple water treatment tablets stacked one on another before a single, opaque layer of film is sealed; and providing the single, opaque layer of film comprising polyvinyl chloride, the single, opaque layer of film enclosing the plurality of water treatment tablets, the single, opaque layer of film being formulated to resist degradation when in contact with a corrosive substance, the single, opaque layer of film having a generally planar upper surface, a generally planar lower surface, three or more sealed edges created by sealing one or more open edges of the single, opaque layer of film, at least one folded edge created by folding the single, opaque layer of film over itself, the package system comprising an approximate center, the package system comprising an uncoupling guide in between at least one of the three or more sealed edges or the at least one folded edge and the approximate center, the package system comprising a handle in between the uncoupling guide and the approximate center, and the package system comprising a closing mechanism in between the handle and the approximate center.

9. The method of claim 8, wherein the three or more sealed edges are located proximate to a perimeter of the single, opaque layer of film.

10. The method of claim 8 further comprising providing a handle proximate to the three or more sealed edges, wherein the handle is formed by reinforcing a portion of the single, opaque layer of film to support a weight of the plurality of water treatment tablets.

11. The method of claim 8, wherein the closing mechanism is proximate to the three or more sealed edges, wherein the closing mechanism comprises a resealable adhesive configured to allow multiple openings and resealings of the package.

12. The method of claim 11, wherein the closing mechanism comprises a press and seal mechanism.

13. The method of claim 8 further comprising:

providing an uncoupling guide in between at least one of the three or more sealed edges and an approximate center of the single, opaque layer of film;

providing a handle in between the uncoupling guide and the approximate center; and providing a closing mechanism in between the handle and the approximate center.

14. The method of claim 8, wherein the multi-layer array comprises the plurality of water treatment tablets stacked in a plurality of columns arranged in a polygonal shape.

15. The method of claim 8, wherein the single, opaque layer of film is dispensed from a roller before being folded or sealed.

16. A method of manufacturing a package system, the method comprising:

arranging a plurality of water treatment tablets comprising a caustic, light sensitive chemical in a multi-layer array comprising the plurality of water treatment tablets stacked in a plurality of columns arranged in a polygonal shape, each of the plurality of columns comprising multiple water treatment tablets stacked one on another before a single, opaque layer of film is sealed;

enclosing the plurality of water treatment tablets with the single, opaque layer of film, the single, opaque layer of film comprising polyvinyl chloride and being formulated to resist degradation when in contact with a corrosive substance; and forming the package system such that the single, opaque layer of film has a generally planar upper surface, a generally planar lower surface, three or more sealed edges created by sealing one or more open edges of the single, opaque layer of film, and at least one folded edge created by folding the single, opaque layer of film over itself, the package system having an approximate center, an uncoupling guide in between at least one of the three or more sealed edges or the at least one folded edge and the approximate center, a handle in between the uncoupling guide and the approximate center, and a closing mechanism in between the handle and the approximate center.

17. The method of claim 16, wherein forming the package system comprises forming the three or more sealed edges proximate to a perimeter of the single, opaque layer of film.

18. The method of claim 16, further comprising providing a handle proximate to the three or more sealed edges.

19. The method of claim 18, wherein providing the handle comprises forming the handle proximate to the three or more sealed edges.

20. The method of claim 18, wherein the single, opaque layer of film is dispensed from a roller before being folded or sealed.

* * * * *